US009796499B2

(12) United States Patent
Schultz

(10) Patent No.: US 9,796,499 B2
(45) Date of Patent: Oct. 24, 2017

(54) EYE SHIELD AND FRAMES DISPENSER

(71) Applicant: TIDI Products, LLC, Neenah, WI (US)

(72) Inventor: Bradly Thomas Schultz, Greenville, WI (US)

(73) Assignee: TIDI Products, LLC, Neenah, WI (US)

( * ) Notice: Subject to any disclaimer, the term of this patent is extended or adjusted under 35 U.S.C. 154(b) by 14 days.

(21) Appl. No.: 14/264,775

(22) Filed: Apr. 29, 2014

(65) Prior Publication Data

US 2014/0318084 A1 Oct. 30, 2014

Related U.S. Application Data

(60) Provisional application No. 61/817,418, filed on Apr. 30, 2013.

(51) Int. Cl.

| | |
|---|---|
| ***B65D 5/00*** | (2006.01) |
| ***B65D 5/42*** | (2006.01) |
| ***B65D 5/72*** | (2006.01) |
| ***B65D 5/498*** | (2006.01) |

(52) U.S. Cl.

CPC ..... *B65D 5/42* (2013.01); *B65D 5/48048* (2013.01); *B65D 5/726* (2013.01)

(58) Field of Classification Search

CPC ..... B65D 1/22; B65D 1/225; B65D 5/4204; B65D 5/5035; B65D 5/6661; B65D 5/5455; B65D 5/705; B65D 5/703; B65D 5/48032; B65D 5/48024; B65D 5/48022; B65D 5/48028; B65D 85/1036

USPC ..... 206/756

See application file for complete search history.

(56) References Cited

U.S. PATENT DOCUMENTS

| | | | | | |
|---|---|---|---|---|---|
| 312,851 | A | * | 2/1885 | Heron | B65D 5/22 229/151 |
| 511,078 | A | * | 12/1893 | Hibson | 229/154 |
| 1,225,705 | A | * | 5/1917 | Dyson | B65D 21/0213 206/509 |
| 1,667,975 | A | * | 5/1928 | Labombarde | 229/152 |
| 1,783,453 | A | * | 12/1930 | Reisert | 206/223 |
| 1,810,956 | A | * | 6/1931 | Frankenstein | 229/103.2 |
| 1,940,183 | A | * | 12/1933 | Petersen | 229/117.16 |
| 2,647,679 | A | * | 8/1953 | Schilling et al. | 229/120.36 |
| 3,164,298 | A | * | 1/1965 | Repko | A47G 19/32 206/738 |
| 3,184,117 | A | * | 5/1965 | Sanderson | 222/183 |
| 3,195,425 | A | * | 7/1965 | Taggart | 493/95 |
| 3,301,460 | A | * | 1/1967 | Harrison | 229/120.26 |
| 3,450,330 | A | * | 6/1969 | Pierce, Jr. | 229/154 |
| 3,750,933 | A | * | 8/1973 | Nicolay | 229/240 |
| 3,826,420 | A | * | 7/1974 | Bamburg et al. | 229/102 |
| 3,929,273 | A | * | 12/1975 | Swanson | 206/562 |
| 4,432,490 | A | * | 2/1984 | Roberts | 229/112 |
| 4,459,127 | A | * | 7/1984 | Kunzel | 493/69 |

(Continued)

*Primary Examiner* — Anthony Stashick
*Assistant Examiner* — Ernesto Grano
(74) *Attorney, Agent, or Firm* — Boyle Fredrickson, S.C.

(57) ABSTRACT

The present invention provides a blank for forming a tray for dispensing eye shields. The present invention also provides a tray. The tray is made from the single blank of material. In another embodiment, the present invention provides an eye shield and frame dispenser including a carton, a frame insert and a shield insert. The carton and inserts are made from a single blank of material.

19 Claims, 7 Drawing Sheets

(56) References Cited

U.S. PATENT DOCUMENTS

| | | | | | |
|---|---|---|---|---|---|
| 4,998,667 | A | * | 3/1991 | McElhaney et al. | 229/120.37 |
| 5,284,293 | A | * | 2/1994 | Alpern | A61B 17/06133 206/63.3 |
| 5,615,767 | A | * | 4/1997 | Eull et al. | 206/278 |
| 5,788,081 | A | * | 8/1998 | Bates | 206/562 |
| 5,823,352 | A | * | 10/1998 | Mena et al. | 206/721 |
| 5,881,877 | A | * | 3/1999 | Adams | 206/373 |
| 5,934,549 | A | * | 8/1999 | Baumgartner et al. | 229/103.2 |
| 5,967,406 | A | * | 10/1999 | Moorman | 229/120.37 |
| 6,237,757 | B1 | * | 5/2001 | Alpern | A61B 17/06061 206/449 |
| 6,971,524 | B1 | * | 12/2005 | Voswinkel | 206/762 |
| 6,981,589 | B2 | * | 1/2006 | Sanders, Jr. | 206/320 |
| 7,533,774 | B2 | * | 5/2009 | Zimmerman | 206/784 |
| 7,708,185 | B2 | * | 5/2010 | Kato | 229/102 |
| 8,028,839 | B2 | * | 10/2011 | Learn | 206/774 |
| 8,783,549 | B2 | * | 7/2014 | Jo | 229/117.08 |
| D713,725 | S | * | 9/2014 | Cedeno | D9/456 |
| D714,149 | S | * | 9/2014 | Cedeno | D9/456 |
| 8,857,642 | B2 | * | 10/2014 | Liebowitz et al. | 220/62 |
| 2004/0011861 | A1 | * | 1/2004 | Wozniacki | 229/147 |
| 2004/0089672 | A1 | * | 5/2004 | Crosland et al. | 222/105 |
| 2006/0097005 | A1 | * | 5/2006 | Hill et al. | 222/105 |
| 2009/0188015 | A1 | * | 7/2009 | Grad et al. | 2/15 |
| 2011/0192852 | A1 | * | 8/2011 | Chebli | 220/592.21 |
| 2013/0020227 | A1 | * | 1/2013 | Stack | 206/570 |
| 2014/0054360 | A1 | * | 2/2014 | Scrimger | 229/120.08 |
| 2014/0175101 | A1 | * | 6/2014 | Dixon | 220/529 |

* cited by examiner

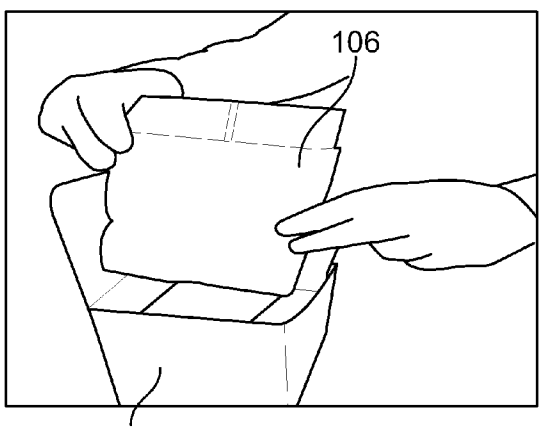
FIG. 9
FIG. 10
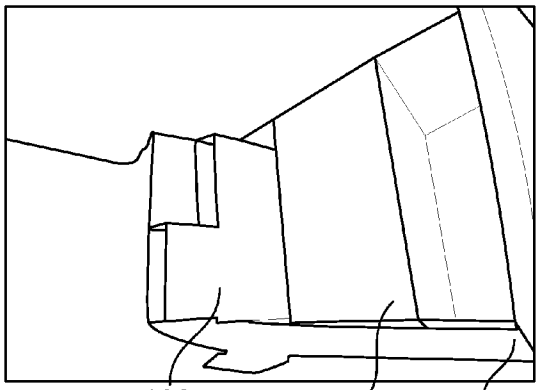
FIG. 11
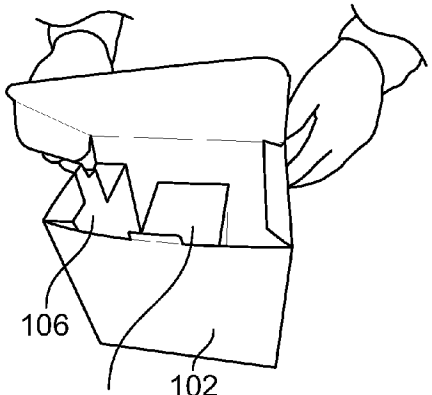
FIG. 12

EYE SHIELD AND FRAMES DISPENSER

CROSS-REFERENCE TO RELATED APPLICATIONS

The present application claims the benefit of U.S. Provisional Application No. 61/817,418, filed Apr. 30, 2013, the contents of which are incorporated herein by reference.

FEDERALLY SPONSORED RESEARCH OR DEVELOPMENT

N/A

TECHNICAL FIELD

The present invention generally relates to a tray and a dispenser for eye shields or eye shield frames. The eye shields can be used in connection with medical, dental, or other applications.

BACKGROUND OF THE INVENTION

Healthcare professionals often use disposable eye shields to prevent splatter of bodily fluids such as spittle and blood from entering the eyes to prevent potential infections. Healthcare professionals need to be able to have quick and ready access to such eye shields. The present invention provides storage and convenient access to eye shields.

SUMMARY OF THE INVENTION

The present invention provides a unique tray for eye shields or frames that is easily constructed from a single blank of material, such as cardboard or plastic. The present invention also provides a blank for forming a tray. The blank includes a front panel, and a front panel flap located along a first fold line of the front panel. The blank also includes a pair of side flaps attached to the front panel along second and third fold lines, respectively. The blank further includes a top panel attached to the front panel along a fourth fold line, and a pair of side flaps attached to the top panel along fifth and sixth fold lines. The blank also includes a back panel attached to the top panel along a seventh fold line, and a pair of side panels attached to the back panel along eighth and ninth fold lines, respectively. The blank includes a bottom panel attached to the back panel along a tenth fold line, and a pair of side flaps attached to the bottom panel along eleventh and twelfth fold lines, respectively.

The tray is made from a single blank of material, the tray including a front wall, a back wall, a top wall, a bottom wall, and a pair of side walls. The tray further includes an opening between the front and bottom walls, and at least one tab located in the opening In another embodiment, an eye shield and frame dispenser is provided. The dispenser includes a carton formed from a single blank of material, a frame insert inserted into the carton and formed from a single blank of material, and a shield insert inserted into the carton and formed from a single blank of material. The carton blank includes a front panel and a first side panel attached to a first side of the front panel along a first fold line. The carton blank also includes a second side panel attached to a second side of the front panel along a second fold line, and a back panel attached to the second side panel at a side opposite the front panel along a third fold line. A top panel is attached to the front panel along a fourth fold line.

The carton blank further includes a first top side flap attached to a first edge of the top panel along a sixth fold line, a cutout, and a first side bottom panel attached to a bottom edge of the first side panel along an eighth fold line. The blank includes a front bottom panel attached to a bottom edge of the front panel along a ninth fold line, and a second side top flap attached to a top edge of the second side panel along an eleventh fold line. A second side bottom panel is attached to a bottom edge of the second side panel along a twelfth fold line. A back bottom panel is attached to a bottom edge of the second side panel along a fifteenth fold line.

The frame insert blank includes a top panel, a first side panel attached to a first side edge of the top panel along a first fold line, and a second side panel attached to a second side edge of the top panel opposite the first side panel along a second fold line. A top panel flap is attached to a top edge of the top panel along a third fold line. A top panel bottom flap is attached to a bottom edge of the top panel along a fourth fold line. A first side top wing is attached to a top edge of the first side panel along a fifth fold line. A first side bottom wing is attached to a bottom edge of the first side panel along a sixth fold line. A second side top wing is attached to a top edge of the second side panel along a seventh fold line. A first side bottom wing is attached to a bottom edge of the second side panel along an eighth fold line.

The shield insert blank includes a first fold line, a second fold line, a third fold line, a fourth fold line, a fifth fold line, and a sixth fold line.

BRIEF DESCRIPTION OF THE DRAWINGS

To understand the present invention, it will now be described by way of example, with reference to the accompanying drawings in which:

FIG. 9 is a perspective view of an erected frame insert inserted into a carton in accord with the present invention.

FIG. 10 is a perspective view of an erected shield insert being inserted into a carton in accord with the present invention.

FIG. 11 is a perspective view of an erected frame insert and shield insert inserted into a carton in accord with the present invention.

FIG. 12 is a perspective view of a completed eye shield and frame dispenser being closed in accord with the present invention.

DETAILED DESCRIPTION

Figure 1:
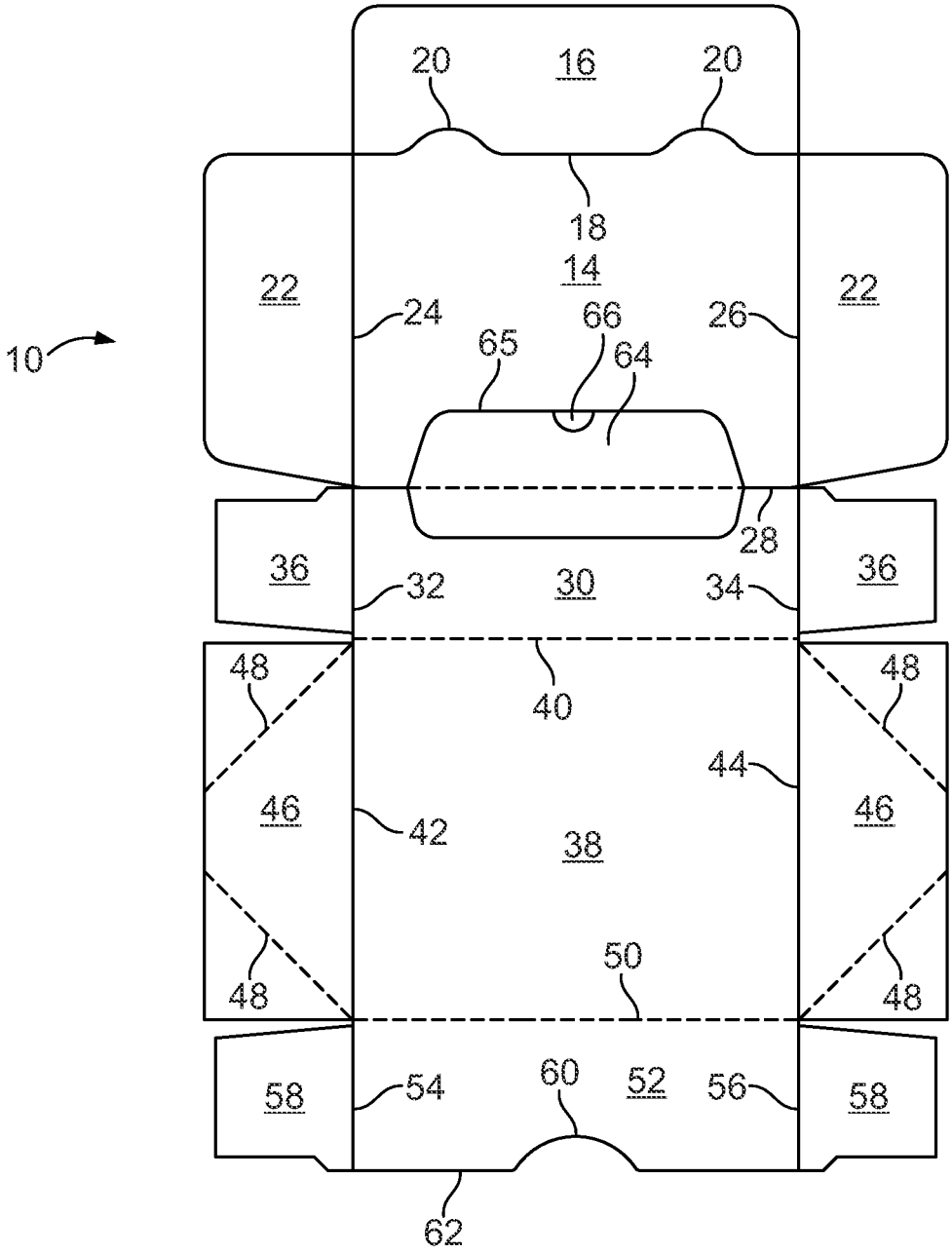
FIG. 1 is a top plan view of a blank for forming a carton made in accordance with the present invention.
Figure 3:
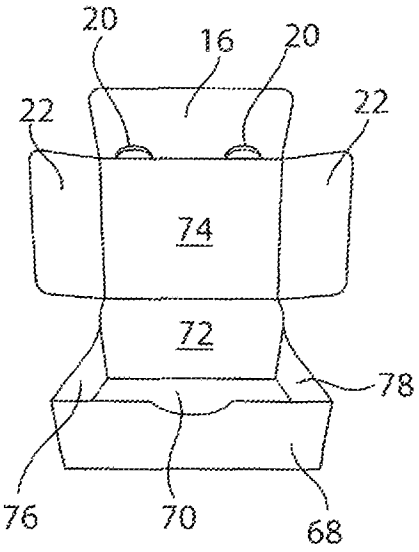
FIG. 3 is a perspective view showing the blank of FIGS. 1 and 2 being further folded into a carton.
Figure 4:
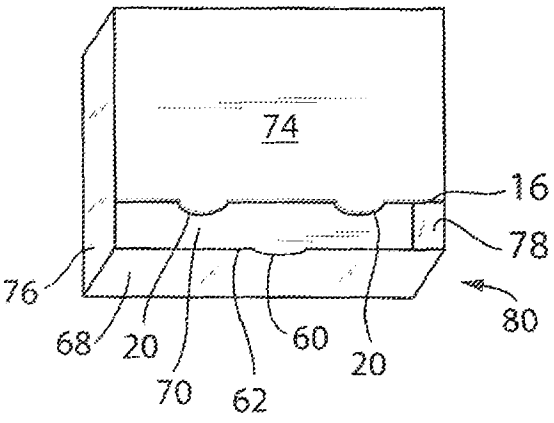
FIG. 4 is a perspective view showing the blank of FIGS. 1-3 being still further folded into a carton
Figure 2:
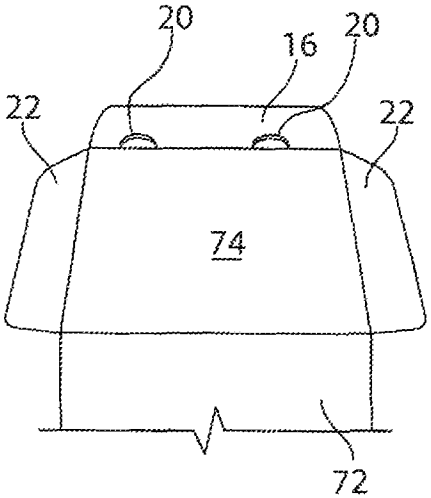
FIG. 2 is a perspective view showing the blank of FIG. 1 being folded into a carton.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIGS. 1-4, a blank 10 for constructing the tray 12 of the present invention is provided in FIG. 1. The tray 10 is preferably constructed from a single blank 10 of material such as cardboard or plastic, although, any suitable material may be used. The blank 10 includes a front panel 14. A front panel flap 16 is located along a first fold line 18 of the front panel 14. The front panel 14 includes a pair of tabs 20 along the first fold line 18. The front panel 14 also includes a pair of side flaps 22 attached along second and third fold lines 24 and 26, respectively.

Attached to the front panel 14 along a fourth fold line 28 is a top panel 30. Attached to the top panel 30 along fifth and sixth fold lines 32 and 34 are side flaps 36.

A back panel 38 is attached to the top panel 30 along a seventh fold line 40. Attached to the back panel 38 along eighth and ninth fold lines 42 and 44 are side panels 46. Side panels 46 include fold lines 48.

Attached to the back panel 38 along a tenth fold line 50 is a bottom panel 52. Attached to the bottom panel 52 along eleventh and twelfth fold lines 54 and 56 are side flaps 58. The bottom panel 52 also includes a semi-circular first cutout 60 located at or near the center of outer edge 62 of the bottom panel 52.

Between the front panel 14 and top panel 30 along the fourth fold line 28 is a second cutout 64 formed by a perforation 65. The cutout 64 includes a finger hole 66 for opening the cutout 64.

To construct a tray 12 using the blank 10, the blank 10 is folded inwards along fold lines 18, 28, 40, and 50. The front panel flap 16 is folded under front panel 14 and glued thereto. The side panels 46 are folded inward along fold lines 42 and 44 until they are substantially perpendicular to the back panel 38. The bottom panel 52 is folded upward along fold line 50 until it is also substantially perpendicular to the back panel 38. Side flaps 58 are glued to the inner surface of the side panels 46. Top panel 30 is folded upwards along fold line 30 until it is substantially perpendicular to the back panel 38. Side flaps 36 are glued to the inner surface of the side panels 46. To complete the tray, the front panel 14 is folded inward along fold line 28. Side flaps 22 are folded inward along fold lines 24 and 26 such that they are on the insides of the side panels 46. The front panel 13 is of a smaller dimension than the back panel 38 such that the opening 80 is created with tabs 20 extending into the opening 80.

When constructed, the tray 12 includes a bottom wall 68, a back wall 70, a top wall 72, and a front wall 74. It also includes side walls 76 and 78. The tray further includes an opening 80 for viewing and dispensing glasses or frames therethrough. The tabs 20 serve to retain glasses or frames in the tray 12 until removed by a user. The cutout 60 provides access for a user's hand or fingers to remove glasses or frames from the tray 12. The tray 12 can be mounted on a wall or in a holder (not shown) such that the tray 12 can be easily replaced when the supply of glasses or frames therein is exhausted. Optionally, cutout 64 can be manually opened along perforation 65 using finger hole 66 to permit re-fill of glasses or frames in the tray 12. Additionally, the front panel 14 can be lifted to allow access to the interior of the tray 12 to allow placement of eye shields or frames.

In another embodiment shown in FIGS. 5-18, an eye shield and frames tray assembly 100 is shown. The assembly 100 includes a carton 102, a frame insert 104, and a shield insert 106, each of which are preferably made from single blanks of a cardboard material, although other suitable materials such as plastic may be used.

Figure 16:
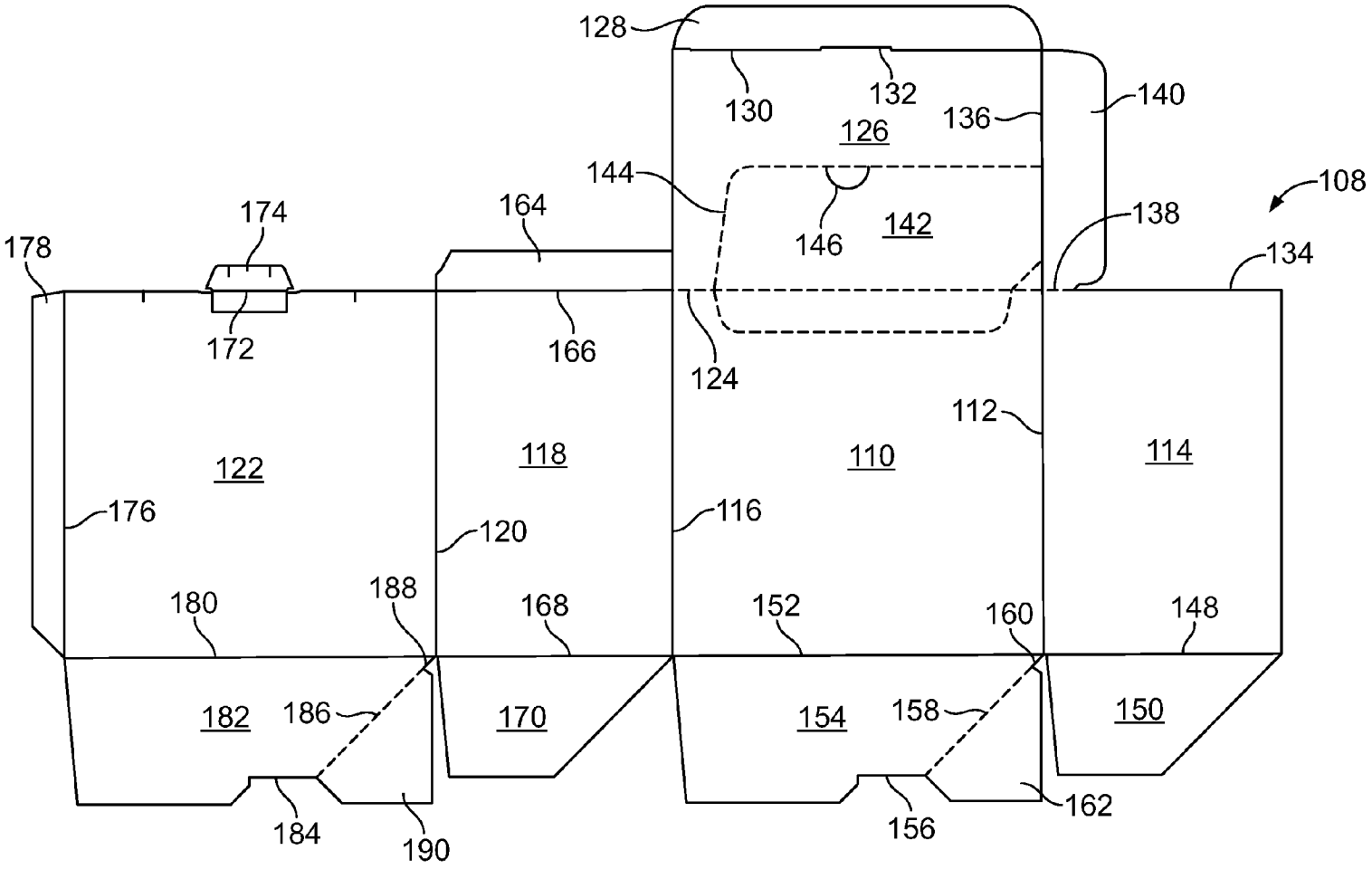
FIG. 16 is a top plan view of a carton blank in accord with the present invention.

The carton 102 is made from a single blank 108 shown in FIG. 16. The blank 108 includes a front panel 110. Attached to a first side of the front panel 110 along a first fold line 112 is a first side panel 114. Attached to a second side of the front panel 110 along a second fold line 116 is a second side panel 118. Attached to the second side panel 118 at a side opposite the front panel 110 along a third fold line 120 is a back panel 122.

Attached to the front panel 110 along a fourth fold line 124 is a top panel 126. The top panel 126 includes a first top flap 128 at a free edge of the top panel 126 defined by a fifth fold line 130. Fifth fold line 130 includes a slot 132 along its length. Attached to a first edge of the top panel 126 and to a portion of a top edge 134 of the first side panel 114 along sixth and seventh fold lines 136 and 138 is a first top side flap 140. Extending into both the top panel 126 and the front panel 110 is a cutout 142 defined by a perforated line 144. The cutout 142 includes a punchout 146.

Attached to a bottom edge of the first side panel 114 along an eighth fold line 148 is a generally trapezoidal first side bottom panel 150. Attached to a bottom edge of the front panel 110 along a ninth fold line 152 is a front bottom panel 154. The front bottom panel 154 includes a stepped portion 156. A tenth fold line 158 extends from the stepped portion 156 and a first corner 160 of the front bottom panel 154 to define a first bottom panel tab 162.

A second side top flap 164 is attached to a top edge of the second side panel 118 along an eleventh fold line 166. Attached to a bottom edge of the second side panel 118 along a twelfth fold line 168 is a generally trapezoidal second side bottom panel 170.

Attached to a top edge of the back panel 122 along a thirteenth fold line 172 is a tab 174. Attached to an edge of the back panel 122 opposite the second side panel 118 along a fourteenth fold line 176 is a glue flap 178. Attached to a bottom edge of the second side panel 118 along a fifteenth fold line 180 is a back bottom panel 182. The back bottom panel 182 includes a second stepped portion 184. A sixteenth fold line 186 extends from the second stepped portion 184 and a first corner 188 of the back bottom panel 182 to define a second bottom panel tab 190.

Figure 17:
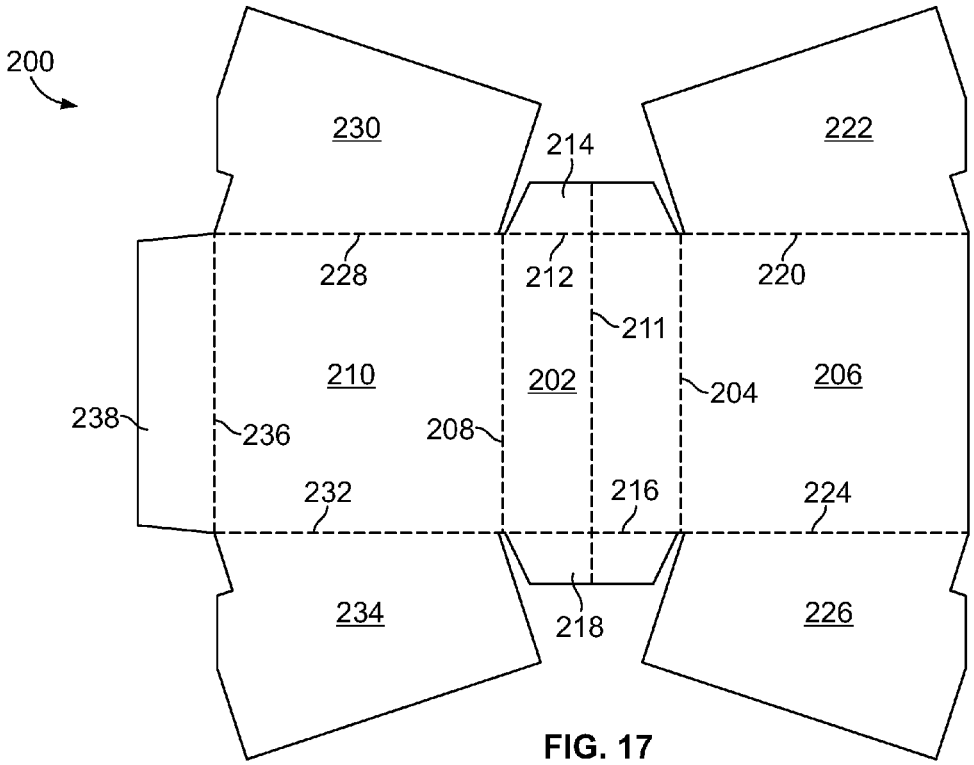
FIG. 17 is a top plan view of a frame insert blank in accord with the present invention.
Figure 18:
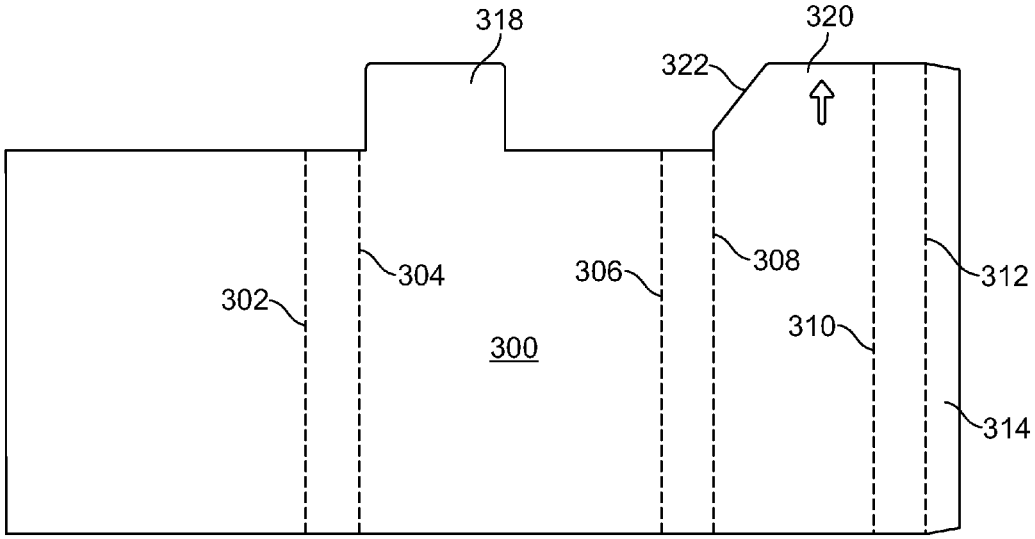
FIG. 18 is a top plan view of a shield insert blank in accord with the present invention.

The frame insert 104 is formed from a single blank 200 shown in FIG. 17. The frame insert blank 200 includes a top panel 202. Attached to a first side edge of the top panel 202 along a first fold line 204 is a first side panel 206. Attached to a second side edge of the top panel 202 opposite the first side panel 206 along a second fold line 208 is a second side panel 210. Attached to a top edge of the top panel 202 along a third fold line 212 is a top panel top flap 214. Attached to a bottom edge of the top panel 202 along a fourth fold line 216 is a top panel bottom flap 218.

Attached to a top edge of the first side panel 206 along a fifth fold line 220 is a first side top wing 222. Attached to a bottom edge of the first side panel 206 along a sixth fold line 224 is a first side bottom wing 226. The top panel also includes a tenth fold line 211 running vertically through its center as well as through the centers of the top panel top and bottom flaps 214 and 218.

Attached to a top edge of the second side panel 210 along a seventh fold line 228 is a second side top wing 230. Attached to a bottom edge of the second side panel 210 along an eighth fold line 232 is a first side bottom wing 234. Attached to an edge of the second side panel 210 opposite the top panel 202 along a ninth fold line 236 is a glue flap 238.

The shield insert 106 (FIG. 18) is also preferably made from a single blank 300 of cardboard material. The shield insert blank 300 includes a first fold line 302, a second fold line 304, a third fold line 306, a fourth fold line 308, a fifth fold line 310, and a sixth fold line 312. The sixth fold line 312 defines a glue flap 314.

Along a top edge 316 of the blank 300 extends a generally rectangular tab portion 318 between the second and third fold lines 304 and 306, and closer to the second fold 304. A raised portion 320 also extends from the top edge 316. The raised portion 320 includes an inclined section 322.

Figure 6:
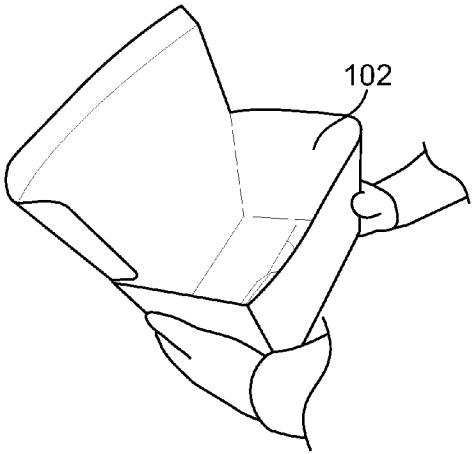
FIG. 6 is a perspective view of an erected carton in accord with the present invention.
Figure 13:
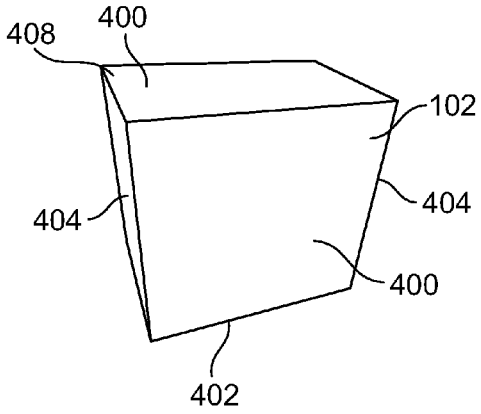
FIG. 13 is a perspective view of a completed closed eye shield and frame dispenser in accord with the present invention.

The assembly 100 is constructed from the blanks 108, 200 and 300 as described below. The carton 102 includes a top 400, a bottom 402, side walls 404, a front wall 406 and a back wall 408 (FIG. 13). To erect the carton 102 from the carton blank 108, the front panel 110, first side panel 114, second side panel 118 and back panel 122 are folded inward along fold lines 112, 116 and 120. First side bottom panel 150, front bottom panel 154, second side bottom panel 170, back bottom panel 182 are also fold inward along fold lines 148, 152, 168 and 180 to form the bottom 402 of the carton 102. The glue flap 178 is glued to the first side panel 114 (FIG. 6).

Figure 8:
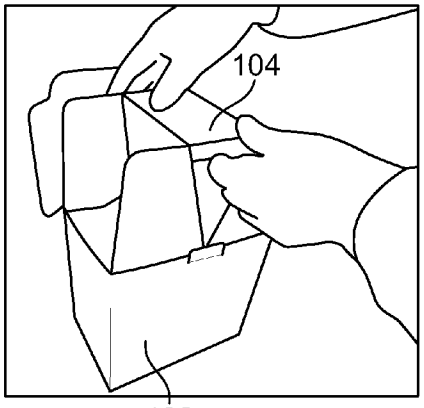
FIG. 8 is a perspective view of an erected frame insert being inserted into a carton in accord with the present invention.
Figure 5:
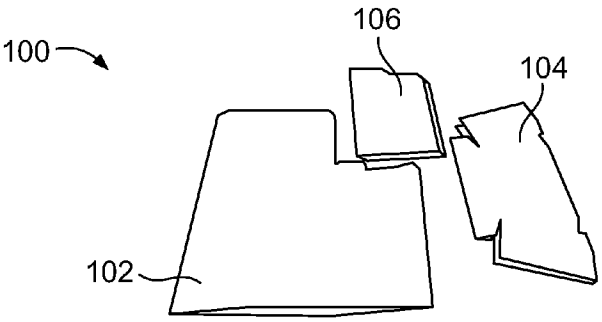
FIG. 5 is a perspective view of the carton, frame insert and shield insert in accord with the present invention.
Figure 7:
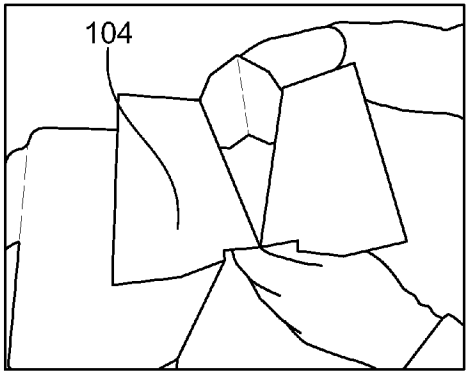
FIG. 7 is a perspective view of an erected frame insert in accord with the present invention.

The frame insert 104 is erected from frame insert blank 200 (FIG. 7). First and second side panels 206 and 210 are folded inwardly over top panel 202 along fold lines 204 and 208. First and second side top wings 222 and 230, and first and second side bottom wings 226 and 234 are generally trapezoidal, and are folded outward from the first and second side panel 206 and 210 along fold lines 220, 228, 224 and 232, respectively. Top panel top and bottom flaps 214 and 218 are folded inward toward the top panel 202 along fold lines 212 and 216. Glue flap 238 is glued to the first side panel 150. The erected frame insert 104 is inserted into the center of the carton 102 with the top panel 202 facing up as shown in FIGS. 8 and 9. The wings 222, 230, 226 and 234 are adjacent the front wall 406 and back wall 408 of the carton 102.

The shield insert 106 is erected from shield insert blank 300. The blank 300 is folded inward along fold lines 302, 304, 306, 308, 310 and 312 to form a generally rectangular insert 106. Glue flap 314 is glued to an opposite end 330 of the blank 300. The shield insert 106 is inserted into the carton 102 along one of the side walls 404 as shown in FIG. 10 such that the tab 318 and raised portion 320 are at the top of the carton 102. The carton 102, frame insert 104 and shield insert 106 are shown assembled in FIG. 11.

After eye shields and frames are inserted into the carton 102, the carton 102 is closed by folding in the top panel 126, the first top flap 128, and the first top side flap 140 along fold lines 124, 130, 136, and 138 over the carton 102 (FIG. 12). The first top flap 128 is tucked into the carton 102. Tab 174 is inserted into slot 132 to close the carton 102 (FIG. 13).

Figure 14:
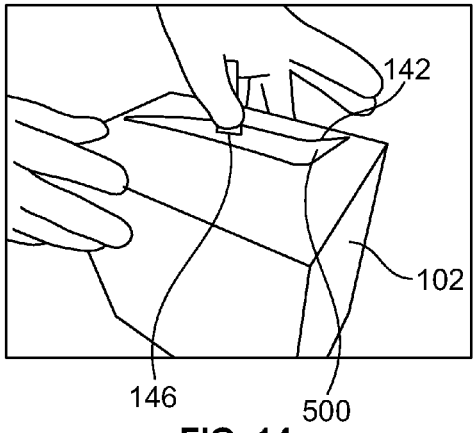
FIG. 14 is a perspective view of an eye shield and frame dispenser being opened in accord with the present invention
Figure 15:
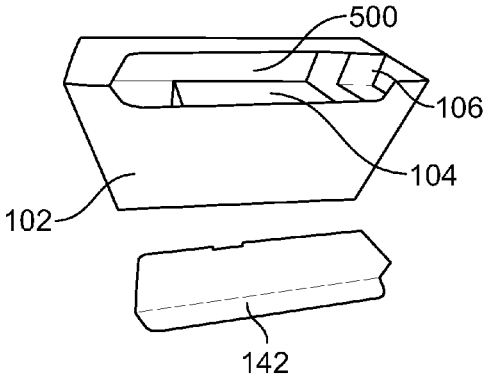
FIG. 15 is a perspective view of an eye shield and frame dispenser opened in accord with the present invention.

To dispense frames and eye shields from the carton 102, a finger or thumb presses on punchout 146 and the cutout 142 is torn from the carton 102 leaving an opening 500 from which the product is dispensed (FIGS. 14 and 15).

While the specific embodiments have been illustrated and described, numerous modifications come to mind without significantly departing from the spirit of the invention, and the scope of protection is only limited by the scope of the accompanying claims.

What is claimed is:

1. An eye shield and frame display comprising:
- a carton firmed from a single blank of material;
- a frame insert inserted into the carton and formed from a single blank of material; and
- a shield insert inserted into the carton and formed from a single blank of material, wherein the carton blank includes:
- a front panel;
- a first side panel attached to a first side of the front panel along a first fold line;
- a second side panel attached to a second side of the front panel along a second fold line;
- a back panel attached to the second side panel at a side opposite the front panel along a third fold line;
- a top panel attached to the front panel along a fourth fold line;
- a first top side flap attached to a first edge of the top panel along a sixth fold line;
- a cutout;
- a first side bottom parcel attached to a bottom edge of the first side panel along an eighth fold line;
- a front bottom panel attached to a bottom edge of the front panel along a ninth fold line;
- a second side top flap attached to a top edge of the second side panel along an eleventh fold line;
- a second side bottom panel attached to a bottom edge of the second side panel along a twelfth fold line; and
- a back bottom panel attached to a bottom edge of the second side panel along a fifteenth fold line, wherein the cutout is located in the top panel, and wherein the cutout extends into the front panel.

2. The eye shield and frame display of claim 1 wherein the fifth fold line includes a slot along its length, and attached to a top edge of the back panel along a thirteenth fold line is a tab.

3. The eye shield and frame display of claim 1 wherein the cutout is defined by a perforated line, and includes a punchout.

4. The eye shield and frame display of claim 1 wherein the front bottom panel and back bottom panel each include a stepped portion, and a tenth fold line extends from the stepped portion and a first corner of the front bottom panel to define a first bottom panel tab, and a sixteenth fold line extends from the second stepped portion and a first corner of the back bottom panel to define a second bottom panel tab.

5. The eye shield and frame display of claim 1 wherein a glue flap is attached to an edge of the back panel opposite the second side panel along a fourteenth fold line.

6. The eye shield and frame display of claim 1 further wherein the first top side flap is attached a portion of a top edge of the first side panel along a seventh fold line.

7. The eye shield and frame display of claim 1 wherein the top panel includes a first top flap at a free edge of the top panel defined by a fifth fold line.

8. The eye shield and frame display of claim 1 wherein the frame insert blank includes:

a top panel;

a first side panel attached to a first side edge of the top panel along a first fold line:

a second side panel attached to a second side edge of the top panel opposite the first side panel along a second fold line;

a top panel flap attached to a top edge of the top panel along a third fold line;

a top panel bottom flap attached to a bottom edge of the top panel alone a fourth fold line; a first side top wine attached to a top edge of the first side panel along a fifth fold line;

a first side bottom wing attached to a bottom edge of the first side panel along a sixth fold line;

a second side top wing attached to a top edge of the second side panel along a seventh fold line; and a first side bottom wing attached to a bottom edge of the second side panel along an eighth fold line.

9. The eye shield and frame display of claim 8 further comprising a glue flap attached to an edge of the second side panel opposite the top panel along a ninth fold line.

10. The eye shield and frame display of claim 8 wherein the top panel includes a tenth fold line running vertically through its center as well as through the centers of the top panel top and bottom flaps.

11. The eye shield and frame display of claim 1 wherein the shield insert blank includes:

a first fold line;

a second fold line;

a third fold line;

a fourth fold line;

a fifth fold line; and a sixth fold line.

12. The eye shield and frame display of claim 11 wherein the sixth fold line defines a glue flap.

13. The eye shield and frame display of claim 11 further comprising a tab portion along a top edge of the blank between the second and third fold lines, and a raised portion extending from the top edge, the raised portion including an inclined section.

14. A tray made from a single blank of material, the tray including:

a front wall;

a back wall opposing the front wall:

a top wall;

a bottom wall opposing the top wall;

a pair of opposing side walls;

an opening between the front wall and an outer edge of the bottom wall, wherein the opening is formed by the front wall being a smaller dimension than the back wall; and at least one tab located in the opening, wherein configured to dispense product there through, wherein the single blank of material includes:

a from panel;

a front panel flap located along a first fold line of the front panel;

a pair of side flaps attached to the front panel along second and third fold lines, respectively;

a top panel attached to the front panel along a fourth fold line;

a pair of side flaps attached to the top panel along fifth and sixth fold lines;

a back panel attached to the top panel along a seventh fold line;

a pair of side panels attached to the back panel along eighth and ninth fold lines, respectively;

a bottom panel attached to the back panel along a tenth fold line; and a pair of side flaps attached to the bottom panel along eleventh and twelfth fold lines, respectively, and further comprising a first cutout located in the bottom panel, wherein the first cutout is semi-circular and is located near the center of an outer edge of the bottom panel, a second cutout located between the front panel and top panel along the fourth fold line, the second cutout including a finger hole, and at least one tab along the first fold line.

15. The tray of claim 14 further comprising a cutout in an outer edge of tile bottom wall.

16. The tray of claim 14 wherein the at least one tab extends from the front wall.

17. The tray of claim 16 wherein the at least one tab is a first tab, and further comprising a second tab that extends from the front wall.

18. The tray of claim 14 further comprising a cutout between the front wall and the bottom wall for re-filling product.

19. The tray of claim 14 further comprising a from panel flap connected to the front wall, wherein front panel flap is folded under front wall and glued thereto.

* * * * *